US006615482B2

(12) United States Patent
Rand

(10) Patent No.: US 6,615,482 B2
(45) Date of Patent: Sep. 9, 2003

(54) SYSTEM FOR WRAPPING TRANSFORMER CORES FROM AMORPHOUS METAL STRIPS

(75) Inventor: Mark E. Rand, Apison, TN (US)

(73) Assignee: ABB Inc., Raleigh, NC (US)

( * ) Notice: Subject to any disclaimer, the term of this patent is extended or adjusted under 35 U.S.C. 154(b) by 0 days.

(21) Appl. No.: 10/083,182

(22) Filed: Feb. 26, 2002

(65) Prior Publication Data

US 2002/0080000 A1 Jun. 27, 2002

Related U.S. Application Data

(62) Division of application No. 09/430,561, filed on Oct. 29, 1999, now Pat. No. 6,374,480, which is a division of application No. 09/078,007, filed on May 13, 1998, now abandoned.

(51) Int. Cl.[7] ..... H01F 7/06

(52) U.S. Cl. ..... 29/602.1; 29/413; 29/456; 29/564.6; 29/606; 29/609; 29/605; 29/738; 140/147

(58) Field of Search ..... 29/413, 564.6, 29/602.1, 606, 609, 605, 738, 456; 140/149

(56) References Cited

U.S. PATENT DOCUMENTS

| | | | | |
|---|---|---|---|---|
| 2,657,456 A | | 11/1953 | Moody | 29/155.57 |
| 3,049,793 A | | 8/1962 | Cooper | 29/155.57 |
| 4,741,096 A | | 5/1988 | Lee et al. | 29/605 |
| 4,789,849 A | | 12/1988 | Ballard et al. | 336/210 |
| 4,814,736 A | | 3/1989 | Lee et al. | 336/213 |
| 4,842,798 A | | 6/1989 | Mott | 264/219 |
| 4,972,168 A | | 11/1990 | Grimes et al. | 336/213 |
| 4,972,573 A | * | 11/1990 | Yamamoto et al. | 29/609 |
| 4,993,140 A | | 2/1991 | Grimes et al. | 29/606 |
| 4,993,141 A | | 2/1991 | Grimes et al. | 29/606 |
| 5,037,706 A | | 8/1991 | Lin et al. | 428/593 |
| 5,046,235 A | * | 9/1991 | Taneda et al. | 29/606 |
| 5,055,815 A | | 10/1991 | Yamamoto et al. | 336/196 |
| 5,063,654 A | | 11/1991 | Klappert et al. | 29/609 |
| 5,093,981 A | | 3/1992 | Ballard et al. | 29/609 |
| 5,134,771 A | | 8/1992 | Lee et al. | 29/609 |
| 5,181,311 A | | 1/1993 | Lee | 29/609 |
| 5,191,700 A | | 3/1993 | Klappert et al. | 29/609 |
| 5,226,222 A | | 7/1993 | Hanaoka et al. | 29/606 |
| 5,230,139 A | | 7/1993 | Klappert et al. | 29/564.6 |
| 5,240,541 A | * | 8/1993 | Lin et al. | 156/270 |
| 5,261,152 A | | 11/1993 | Simozaki | 29/609 |
| 5,285,565 A | * | 2/1994 | Ballard et al. | 29/609 |
| 5,291,648 A | | 3/1994 | Ballard et al. | 29/564.6 |
| 5,309,627 A | | 5/1994 | Burrage et al. | 29/738 |
| 5,315,754 A | | 5/1994 | Klappert et al. | 29/609 |
| 5,321,883 A | | 6/1994 | Klappert et al. | 29/729 |
| 5,329,270 A | | 7/1994 | Freeman | 336/213 |
| 5,347,699 A | | 9/1994 | Ward | 29/413 |
| 5,398,403 A | | 3/1995 | Freeman | 29/609 |
| 5,441,783 A | | 8/1995 | Silgailis et al. | 428/37 |
| 5,528,817 A | | 6/1996 | Klappert et al. | 29/564.6 |
| 5,628,861 A | * | 5/1997 | Segal | 156/291 |
| 5,671,524 A | * | 9/1997 | Damsky et al. | 29/596 |

FOREIGN PATENT DOCUMENTS

| | | |
|---|---|---|
| WO | WO 94/29889 | 12/1994 |

* cited by examiner

*Primary Examiner*—A. Dexter Tugbang
*Assistant Examiner*—Paul D Kim
(74) *Attorney, Agent, or Firm*—Woodcock Washburn LLP

(57) ABSTRACT

An amorphous magnetic core is produced by wrapping cut strips of amorphous metal about a mandrel to form a distributed gap core. The cut strips are secured to the mandrel during assembly by wrapping the strips with amorphous metal ribbons that have been weakened in predetermined areas but not fully parted. After the core has been built to its desired size, the weakened ribbons are completely parted. This method of making an amorphous magnetic core produces a tightly wound distributed gap core without the need for a belt winder or specialized strip holding devices.

17 Claims, 3 Drawing Sheets

SYSTEM FOR WRAPPING TRANSFORMER CORES FROM AMORPHOUS METAL STRIPS

A utility patent application under 37 C.F.R 1.53(b). divisional of prior application Ser. No. 09/430,561, filed Oct. 29, 1999, now U.S. Pat. No. 6,374,480 which is a divisional of Ser. No. 09/078,007, filed May 13, 1998, now abandoned.

FIELD OF THE INVENTION

This invention relates to electrical transformers. More particularly, this invention relates to a method and apparatus for making a jointed magnetic core from amorphous metal ribbons.

BACKGROUND OF THE INVENTION

Several methods and apparatus have been proposed for manufacturing jointed magnetic cores. However, these methods and apparatus often require specialized hardware for holding fully parted strips and therefore have proven unnecessarily expensive and complicated.

Current methods for constructing a jointed magnetic core from fully parted amorphous metal strips utilize belt winders and specialized holding devices to secure fully parted strips during construction of the core. For example, U.S. Pat. No. 3,049,793 ('793) discloses using a belt nester in a process wherein cut lengths of conventional metal are wrapped or nested about a rotating arbor by a continuous belt. U.S. Pat. Nos. 5,230,139 ('139 Patent) and U.S. Pat. No. 5,315,754 ('754 Patent), extend upon the belt nester concept to disclose a method of producing a transformer core using amorphous metal strips instead of conventional silicon-iron materials. While the usual thickness of silicon-iron materials is about 0.15 to about 0.3 millimeter, amorphous alloys are much thinner, typically about 0.025 millimeter. Because amorphous alloys are thinner, they slide easily and are less rigid than conventional silicon-iron materials. In order to deal with the problems presented by the lack of rigidity of the amorphous metal, the '139 Patent and '754 Patent disclose special steering and flattening devices that have been added to the basic belt nester configuration. Further, manual and automatic optical methods are disclosed for maintaining a correct lap in the joint area. Thus, these known methods and apparatus employ complicated and specialized components for holding the strips in place and maintaining the correct lap.

A second method of making an amorphous jointed core which similarly requires using complicated clamps and holding devices, involves wrapping cut strips around a non-rotating mandrel. For example, U.S. Pat. No. 5,093,981 ('981 Patent) discloses a process wherein cut strips are transported to and wrapped around a non-rotating arbor. After wrapping, the strips are secured with specialized clamp and belt holding devices. Additional strips are added until the core reaches the desired size. U.S. Pat. No. 5,309,627 ('627 Patent) discloses a method of making a non-circular cross section core by wrapping individual packets of core strips around a stationary mandrel. The method disclosed in the '627 Patent requires multiple rollers and pressure pads to wrap and hold the cut strips around the mandrel. U.S. Pat. No. 5,261,152 ('152 Patent) discloses a method for manufacturing an amorphous magnetic core by supplying cut sheets which are wrapped around a rectangular mandrel. The cut sheets are either manually or automatically fastened with tape while being held in position with pressers. Thus, the '152 Patent, '627 Patent, and '981 Patent require considerable handling of the cut strips as well as complex clamping and holding equipment.

Another method of making a jointed core is disclosed in U.S. Pat. No. 2,657,456 ('456 Patent). The method disclosed in the '456 Patent creates a joint by weakening each layer of the core at predetermined positions and thereafter mechanically breaking the weakened areas to create a joint in the core. Although the method of the '456 patent was intended for the manufacture of cores from conventional silicon-iron materials, it is conceivable that the method of the '456 Patent could be applied to amorphous materials as well. However, there are several difficulties that could be expected from using the method of the '456 Patent with amorphous materials. An amorphous core has thousands of layers, and therefore would require thousands of the operations disclosed in the '456 Patent to create the weakened areas. It is common when processing amorphous metals to process multiple strips together to reduce the number of operations required. This would make this method much more feasible with amorphous metals. Also, when cutting a strip of amorphous metal to weaken an area for later breaking, an undesirable burr on the cut edge often occurs. The presence of this burr creates an undesirable lack of tightness in the wound core. Furthermore, the preferred joint for use with amorphous metals is a fully or almost fully lapped joint. Such a joint may not be constructed with the disclosed method without adding additional steps such as relacing around a smaller mandrel, or by stopping the process to cut and overlap the core strip. Thus, the method disclosed in the '456 Patent is not optimal for making an amorphous metal jointed core.

Therefore, an object of the present invention is to provide a method and apparatus for producing an amorphous metal distributed gap core without the use of a belt nester and without requiring elaborate clamping and holding devices to secure the fully parted strips. It is a further object to provide a method that allows the automatic cutting and positioning of strips to ensure proper joint location without requiring operator attention to the process.

SUMMARY DESCRIPTION OF THE INVENTION

The above objects have been met in accordance ; the present invention by providing a method for making a transformer core from amorphous metal strip using a mandrel, wherein the transformer core has a joint region. The method comprises the following steps: wrapping fully parted metal strip around the mandrel, wherein the strip has a longitudinal edge and a transverse edge; and wrapping amorphous metal ribbon over the fully parted metal strip so as to secure the fully parted metal strip to the mandrel, wherein the amorphous metal ribbon has a weakened area located in the transformer joint region. The method may also comprise the step of interweaving a plurality of strips with the ribbon around the mandrel so as to form layers of strips and layers of ribbon around the mandrel and thereby secure the plurality of strips to the mandrel with the ribbon, wherein each of the layers of ribbon has a weakened area in the joint region of the core.

The method may further comprise the step of fully parting the ribbon in the joint region. The core may be annealed before or after parting the ribbon in the joint region.

The amorphous metal ribbon may comprise one or more ribbons that have been spliced together. Alternatively, the amorphous metal ribbon may comprise a plurality of ribbons.

The fully parted metal strip may comprise one or more groups of cut metal ribbon. The longitudinal edges of the cut metal ribbon in each group are substantially aligned and the transverse edges in each group are substantially aligned. The strip may comprise a plurality of groups of cut metal ribbon, wherein the longitudinal edges of the cut metal ribbon in each group are substantially aligned and the transverse edges of the cut metal ribbon in each group are substantially aligned, while the longitudinal edges of adjacent groups are substantially aligned and transverse edges of adjacent groups are staggered with respect to each other.

The metal ribbon may be weakened in predetermined areas by partially cutting the ribbon. The ribbon may be cut from each longitudinal edge while leaving an uncut portion in the center of the ribbon.

According to another aspect of the invention there is disclosed a system for wrapping transformer cores from amorphous metal strips and a ribbon of amorphous metal ribbon having weakened areas. The system comprises the following items: a strip supply mechanism for providing cut strips of amorphous metal; a ribbon supply mechanism for providing a ribbon of amorphous metal; a rotating winding mechanism situated relative to the strip supply mechanism and the ribbon supply mechanism so that as the winding mechanism rotates, the ribbon and the cut strips are fed onto the mandrel and interwoven with each other so as to form layers of strips and layers of ribbon around the winding mechanism, thereby securing the cut strips to the winding mechanism with the ribbon.

The strip supply mechanism may comprise a moveable belt and clamp, wherein the clamp secures the strip to the moveable belt while the strip is transported to the winding mechanism and the clamp releases the strip when the strip is wound onto the winding mechanism.

The ribbon supply mechanism may comprise the following items: a ribbon payoff from which the ribbon is unspooled; an encoder for tracking the length of ribbon and determining the appropriate location to weaken the ribbon; and a weakening device for weakening the ribbon in the appropriate locations as determined by said encoder. The ribbon supply mechanism may comprise one or more amorphous metal ribbons having weakened areas at predetermined locations.

The winding mechanism may comprise the following items: a mandrel upon which is wound cut strip and the ribbon; and a positioning device operably connected to z he mandrel for adjusting the location of the mandrel as the strip and ribbon are wound onto the mandrel so as to compensate for the increased build of the wound strip and ribbon. The winding mechanism may comprise a movable pressure plate which can be made to come in contact with the ribbon being wound onto the mandrel so as to add tension to the ribbon.

According to another aspect of the invention there is disclosed a machine for wrapping a transformer core having a joint region. The machine comprises the following items: a means for providing amorphous metal fully cut strips; a means for providing one or more amorphous metal ribbon; a means for weakening the amorphous metal ribbon at predetermined locations; and a means for wrapping the strips and the ribbons around a mandrel such that the predetermined locations are in the joint region of the core.

The means for providing amorphous metal fully cut strips may include a transport means for moving amorphous metal fully cut strips to the mandrel. The transport means may comprise one or more amorphous metal ribbons having weakened areas at predetermined locations. The transport means may alternatively comprise a moveable belt and a clamp, wherein the clamp secures the strip to the moveable belt while the strip is transported to the wrapping means and the clamp releases the strip when the strip is wound onto the wrapping means.

The means for wrapping may comprise the following items: a mandrel upon which is wound cut strip and the ribbon; a backplate affixed to the mandrel for guiding the cut strip and ribbon onto the mandrel; and a positioning device operably connected to the mandrel for adjusting the location of the mandrel as the strip and ribbon are wound onto the mandrel so as to compensate for the increased build of the wound strip and ribbon. The wrapping means may further comprise a movable pressure plate which can be made to come in contact with the ribbon being wound onto the mandrel so as to add tension to the ribbon. The machine may have a rotating mandrel.

According to another aspect of the invention there is disclosed a distributed gap core comprising fully parted amorphous metal strips interwoven with one or more non-parted amorphous metal ribbons with weakened areas at predetermined locations within the joint region.

According to another aspect, there is disclosed a distributed gap core comprising fully parted amorphous metal strips interwoven with one or more amorphous metal ribbons with weakened areas at predetermined locations within the joint region, wherein the ribbons have been fully parted after winding into a core. The strips may comprise one or more groups of cut ribbon having substantially aligned longitudinal edges and substantially aligned transverse edges. Alternatively, the strips may comprise groups of cut ribbon having substantially aligned longitudinal edges and substantially aligned transverse edges, wherein adjacent groups have substantially aligned longitudinal edges and transverse edges which are staggered with respect to each other. The core may be annealed before or after the ribbons are parted.

DETAILED DESCRIPTION OF EMBODIMENTS

The present invention provides a method and system for making a jointed magnetic core form with amorphous metal ribbons. The method and system utilize amorphous metal ribbons that are inter-wound with lengths of amorphous metal strip around a mandrel so as to secure the amorphous metal strips during the winding process. The ribbons have weakened areas which ultimately correspond to the core joint and which weakened areas are thereafter broken to allow the core joint to fully open. Thus, in contrast to prior art devices which required specialized equipment such as a belt nester or steering and flattening devices, the present inventive system uses metal ribbons to secure the metal strips during formation of the core. The present method and apparatus for securing parted strips prevents slipping of the strips during rotation and minimizes air spaces between layers without use of strip flattening plates or complex clamps or belts. Further, this is accomplished without the intervention of humans.

Generally, the term "strip" as used by those skilled in the art refers to one or more layers of amorphous magnetic material that have been fully parted to create separate lengths. The strips may be created by any method that results in fully parted strips, but a method that operates by cutting with a shear such as that disclosed in U.S. Pat. No. 4,942,798 is preferred. The term "group" refers to a plurality of strips that are assembled so as to be substantially aligned on both their longitudinal and transverse edges. Finally the term "packet" refers to a plurality of groups that are stacked so that their longitudinal edges are substantially aligned but the transverse edges of adjacent groups are staggered with respect to each other. A packet can be formed from amorphous metal ribbons using machinery such as that described in U.S. Pat. No. 5,063,654 or International Application WO9429889.

Figure 1:
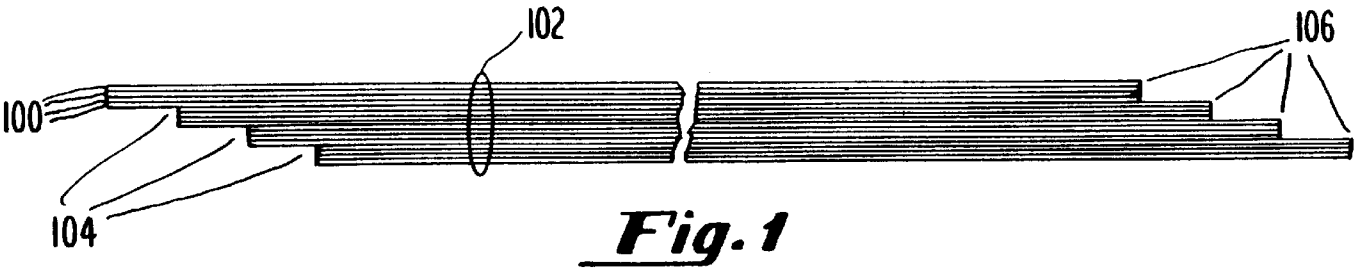
FIG. 1 is a side view of a packet of cut amorphous strips.
Figure 2:
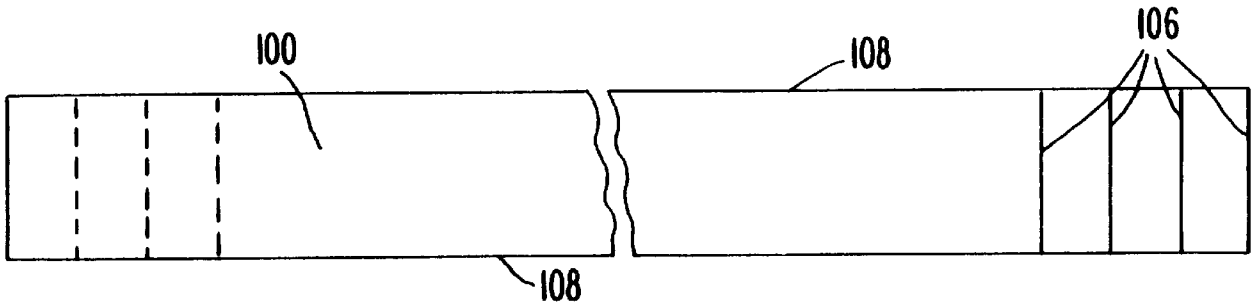
FIG. 2 is a plan view of the packet shown in FIG. 1.

FIGS. 1 and 2 illustrate strips 100 which may be wound to form a transformer core. FIG. 1 provides a side view of packet 102 comprising four groups 104, wherein each group 104 comprises four magnetic strips 100. FIG. 2 provides a top view of the same packet 102. As shown, the transverse edges 106 of each group 104 are in substantial alignment. Adjacent groups 104 have their transverse edges 106 staggered so that adjacent groups 104 overlap at one end of packet 102. As best illustrated in FIG. 2, the longitudinal edges 108 of each group 104 are in substantial alignment.

Figure 3:
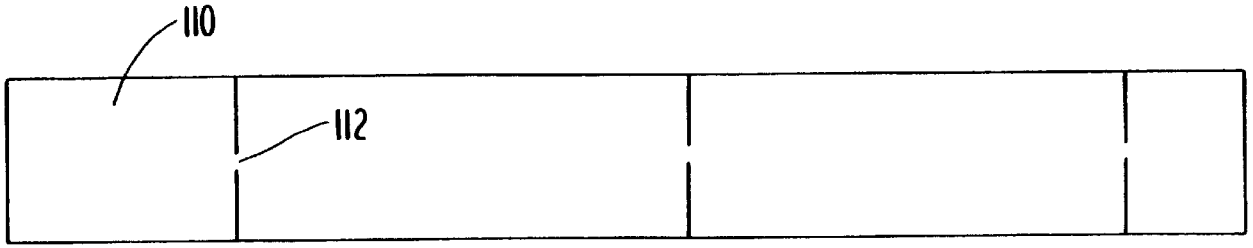
FIG. 3 is a plan view of a ribbon having partially cut weakened areas.

FIG. 3 illustrates amorphous metal ribbon 110 that is employed to hold strips 100 in place during formation of a core. Amorphous metal ribbon 110 has been weakened in specific locations 112 that are located within the core joint region when ribbon 110 is wound into the core. The purpose of weakening ribbon 110 is to provide an area that will selectively part after the core has been wound. The weakened area must be sufficiently strong to keep ribbon 110 from parting before the core is completely wound, but weak enough that it will break at the weakened area when the core is expanded. Ribbon 110 may be weakened by any means that reduces the breaking strength in a selected area, including the following methods: partially parting ribbon 110; by heating ribbon 110 to create brittle regions; laser vaporization of ribbon 110 in selected areas; bending and breaking ribbon 110; abrasive wheel cutting ribbon 110; water jet cutting ribbon 110; and softening before cutting ribbon 110. A preferred method is to shear ribbon 110 inwardly from its edges, leaving a small tab 112 in the center of ribbon 110. The breaking strength of ribbon 110 can be adjusted by changing the width of tab 112 remaining in the center of ribbon 110. A preferred device for shearing ribbon 110 is disclosed in U.S. Pat. No. 5,347,699.

Figure 4:
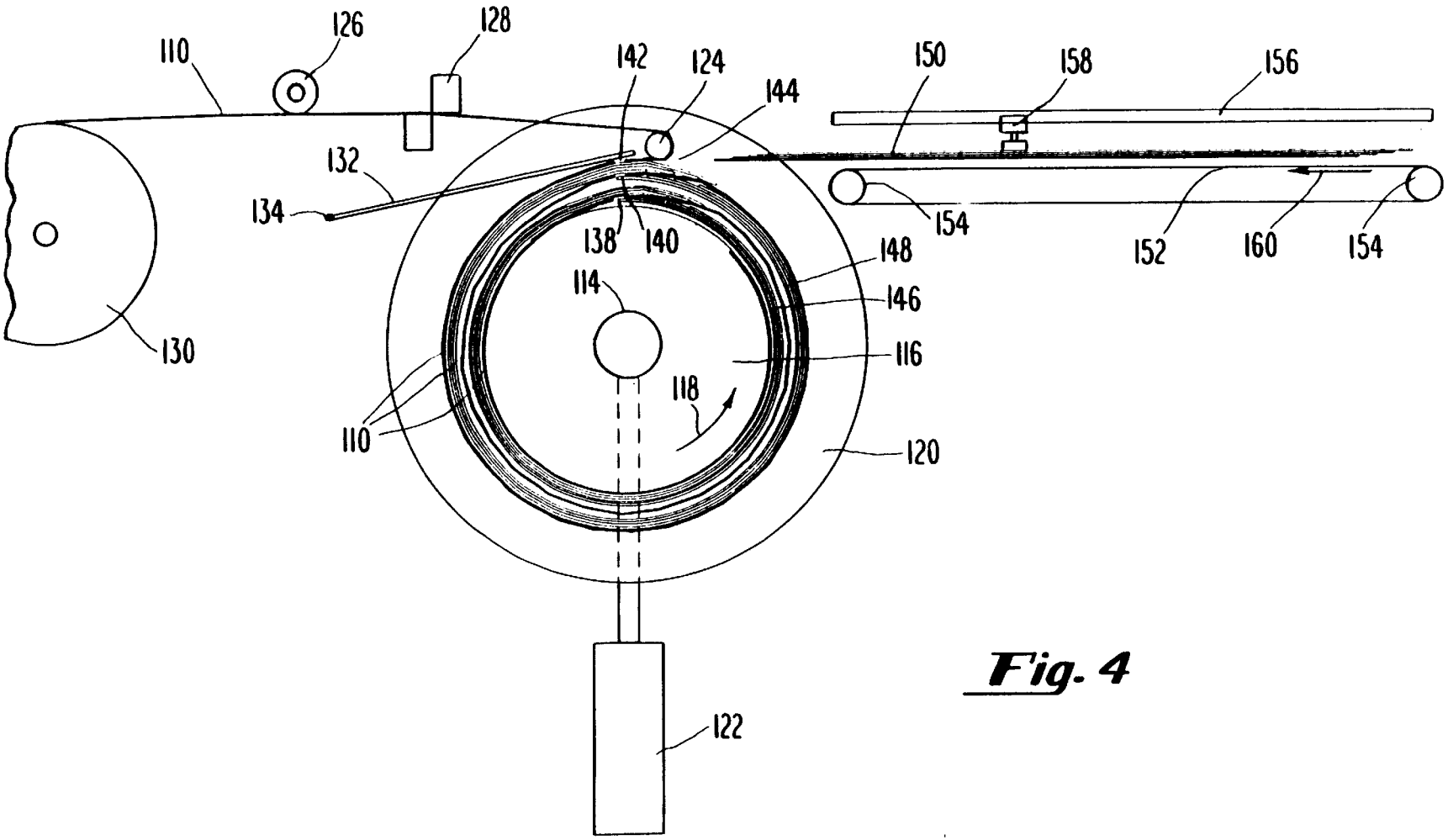
FIG. 4 is a schematic illustration of an inventive system for wrapping a core form with a weakened ribbon and fully parted amorphous strips.

FIG. 4 illustrates a core wrapping system in accordance with the present invention. As shown, the system comprises rotating shaft 114 upon which is mounted wrapping mandrel 116. The inventive system operates to wrap strips 100 and ribbon 110 around mandrel 116 so as to form a core. Mandrel 116 and shaft 114 are rotated in the direction of arrow 118 during winding. Attached to shaft 114 is backplate 120 for guiding ribbon 110 and strips 100 onto mandrel 116. Backplate 120 rotates with mandrel 116 and shaft 114. In the preferred embodiment, wrapping mandrel 116 has a circular shape, but may have other shapes including those with flat or convex sections. Wrapping mandrel 116 can be narrower than strips 100 wrapped around it, but typically has a width equal to or greater than the width of strips 100. Attached to mandrel 116 by temporary means, such as a piece of removable tape, is amorphous metal ribbon 110. Ribbon 110 is preferably a continuous length throughout the core. However, it may be fully cut at places. If ribbon 110 is fully cut, either intentionally or if a break occurs, then the cut ribbon is spliced or secured by attaching it to the outer periphery of the core form, usually by tape. Shaft 114 is attached to shaft positioning device 122, such as a linear actuator which can move shaft 114, mandrel 116, and backplate 120 away from turning bar 124 which is held in a fixed position. Encoder 126 is used to measure the length of ribbon 110 being wound around mandrel 116. Ribbon 110 departs from mandrel 116, wraps around turning bar 124, and continues through weakening means 128, past encoder 126, to payoff spool 130 from which ribbon 110 is supplied. Tension is maintained in ribbon 110 by controlling the braking force on payoff spool 130. If additional tension is required, optional pressure plate 132 can be pressed against the core to resist the slipping of strips 100 around the core. Plate 132 is attached to pivot 134 such that it rests on the outside periphery of the core form to provide pressure, and can be pivoted away to remove pressure.

During the core making process, ribbon 110 from supply spool 130 is fed or unspooled past encoder 126, through weakening means 128, around turning bar 124, and is attached to mandrel 116 by temporary means. Mandrel 116 is rotated in the direction of arrow 118 to pull ribbon 110 onto mandrel 116 until the first position for weakening ribbon 110 is reached. The rotation of mandrel 116 is stopped and weakening means 128 is activated to weaken but not completely part ribbon 110, resulting in weakened area 138. Mandrel 116 is thereafter rotated until weakened area 138 reaches the desired position where it will be joined with fully parted strips 100. Insertion point 144 identifies the location where fully parted strips 100 are inserted onto mandrel 116.

While weakened ribbon 110 is being positioned, a group or packet 146 of strips 100 is fully parted and placed on a transport means consisting of moveable belt 152, driving sprockets 154, slide 156, and carriage clamp 158. Clamp 158 is a pressure cylinder that expands to clamp assembled strips 100 to moveable belt 152, and retracts to release strips 100. Clamp 158 is attached to a carriage that moves along slide 156 and thereby allows for free movement of clamp 158 in a direction parallel to the long axis of strips 100.

Clamp 158 holds cut strips 100 to belt 152. Sprockets 154 are rotated by a motor (not shown) to drive belt 152 in the direction of arrow 160 so as to transport strips 100 toward mandrel 116. When the leading edge of strips 100 arrives at insertion point 144, the rotation of mandrel 116 is continued in the direction of arrow 118. Strips 100 are inserted between ribbon 110 and mandrel 116. The rotation of mandrel 116 exerts a force on weakened ribbon 110 and strips 100 causing ribbon 110 and strips 100 to be wrapped around mandrel 116. In the preferred embodiment, ribbon 110 has a width equal to or less than the width of strips 100. Ribbon 110 is weakened in areas that fall within the joint region of the core, i.e. the area of the core that can be opened for insertion through a prewound coil. Preferentially, ribbon 110 is weakened in locations that approximately coincide with the leading or the trailing edge of the particular groups or packets of strips being wound. When the ribbon 110 is later parted, the ribbon ends will approximately coincide with the ends of adjacent strips, simplifying the reclosing of the strips after being inserted through a prewound coil. Belt 152 continues to feed strips 100 onto mandrel 116 until the leading edges of all cut strips 100 located in a particular packet 146, 148, 150 of strips 100 have been captured by weakened ribbon 110. At that time, clamp 158 is retracted to release its grip on strips 100 and the movement of belt 152 is halted.

Mandrel 116 continues rotating until the next location along ribbon 110 that is to be weakened becomes situated under weakening means 128. The proper location for weakening ribbon 110 is calculated by encoder 126. When the next weakening location has been reached, mandrel 116 is stopped and weakening means 128 is activated. After weakening means 128 has completed its weakening operations, the rotation of mandrel 116 is resumed. Mandrel 116 is rotated until the remaining length of cut strips 100 are wound onto the core or until the next point along the length of ribbon 110 is reached where the next strips are to be inserted and ribbon 110 weakened.

As weakened ribbon 110 is wound onto mandrel 116, it secures parted strips 100 and itself to mandrel 116. Since weakened ribbon 110 is not yet completely parted, a moderate tensile force can be exerted on it to draw it tight against fully parted strips 100 and mandrel 116. If fully parted strips 100 cannot be held tightly with just the tensile force exerted on weakened ribbon 110, optional pressure plate 132 can be added to assist in holding strips 100. Clamp 158 is returned in a direction opposite to arrow 160 along slide 156 to receive the next group or packet of strips 100.

As strips 100 and ribbon 110 are added to the core, the diameter of the core increases. In order to maintain a relatively constant position for the insertion of strips 100, and to prevent the collision of the core with turning bar 124, shaft positioning device 122 moves the shaft 114 and mandrel 116 away from turning bar 124 as the core increases in size. A controlled position can be automatically maintained by use of a position sensing device, such as a proximity sensor, that is not detailed here. Additional cut strips 100 and ribbon 110 are added by repeating the above steps until the entire core is wound.

FIG. 4 shows the system after first packet 146 and second packet 148 have been wrapped onto mandrel 116, and third packet 150 is shown ready to be inserted for wrapping into the core. Ribbon 110 has been weakened at areas 138, 140, and 142 by weakening means 128. Although ribbon 110 is shown encircling each wound packet 146, 148, 150 only one time, in practice mandrel 116 may be rotated more than one revolution for each insertion of strips 100 resulting in more than one ribbon wrap between the inserted groups or packets. This can be done, for example, to increase the holding tension on the core. With each additional layer of ribbon 110, however, an additional weakened area must be created that will be located in the joint region of the core.

As mandrel 116 rotates, the length of ribbon 110 used on a single rotation of shaft 114 is measured by encoder 126. The length measured during a full mandrel 116 rotation approximates the current circumference of the core form. This length can be used to compute the next cutting length. If the next cut strips 100 are to be lapped, the amount of lap desired is added to the measurement of the circumference to determine the cutting length. Each subsequent cut should be increased in length by $2\Pi t$, where t is the thickness of strips 100 in each cut, to compensate for the increase in circumference as the core increases in build. As strips 100 are wound onto mandrel 116, encoder 126 measures the length of ribbon 110 and a new cutting length is calculated. By updating the length at each addition of strips 100 to the core, strip overlap at the joint is maintained at the desired length. Also, by measuring the current core circumference, and combining this with feedback from motor positioning mandrel shaft 114, each group or packet can be arranged at its desired joint location.

Once the core has been wound to the desired diameter or build, ribbon 110 is wrapped around the outermost cut strips 100 and attached to itself to prevent the core from loosening or opening. A protective outer sheet (not shown) can optionally be placed around the core to secure the core. The pressure plate 132, if used, is pivoted away from the core, and the core form is removed for further processing into a finished core. Typical additional processing steps may include forming the core into a rectangular shape with the joints on one side of the core, annealing the core, and adding an edge cover to protect and strengthen the core.

Before the core can be used by inserting it through a prewound coil of a transformer, the weakened areas of ribbon 110 must be fully parted. The parting of the weakened areas is accomplished by placing a hydraulic jacking device within the window of the core and stretching the joint area. Ribbon 110 preferentially parts at each weakened area. Weakened areas 138, 140, 142 can be parted before or after annealing, but because amorphous metal is embrittled by annealing, cleaner separations with less ribbon shattering are usually obtained by parting weakened ribbon 110 before annealing. As an alternate method to expanding the core, weakened ribbon 110 can be parted by breaking a few ribbon layers at a time starting from one side of the joint and working through the core until the other side of the joint is reached. This can be accomplished, for example, by insertion of a pry bar into the joint near the ribbon layers to be parted, and applying pressure that stretches the joint and separates ribbon 110 in the weakened areas.

Distributed gap joints, in particular the fully lapped joint disclosed in U.S. Pat. No. 4,814,736, have been found to be preferred for amorphous metal cores. Other types of joints include those with no laps in the joint area, and those having a combination of lapped strips and non-lapped strips. The present invention can be used to produce cores having non-lapped strips or nearly all lapped strips. In fact, the present invention could be used to wrap any length of strips and therefore almost any type of joint can be formed.

Figure 5:
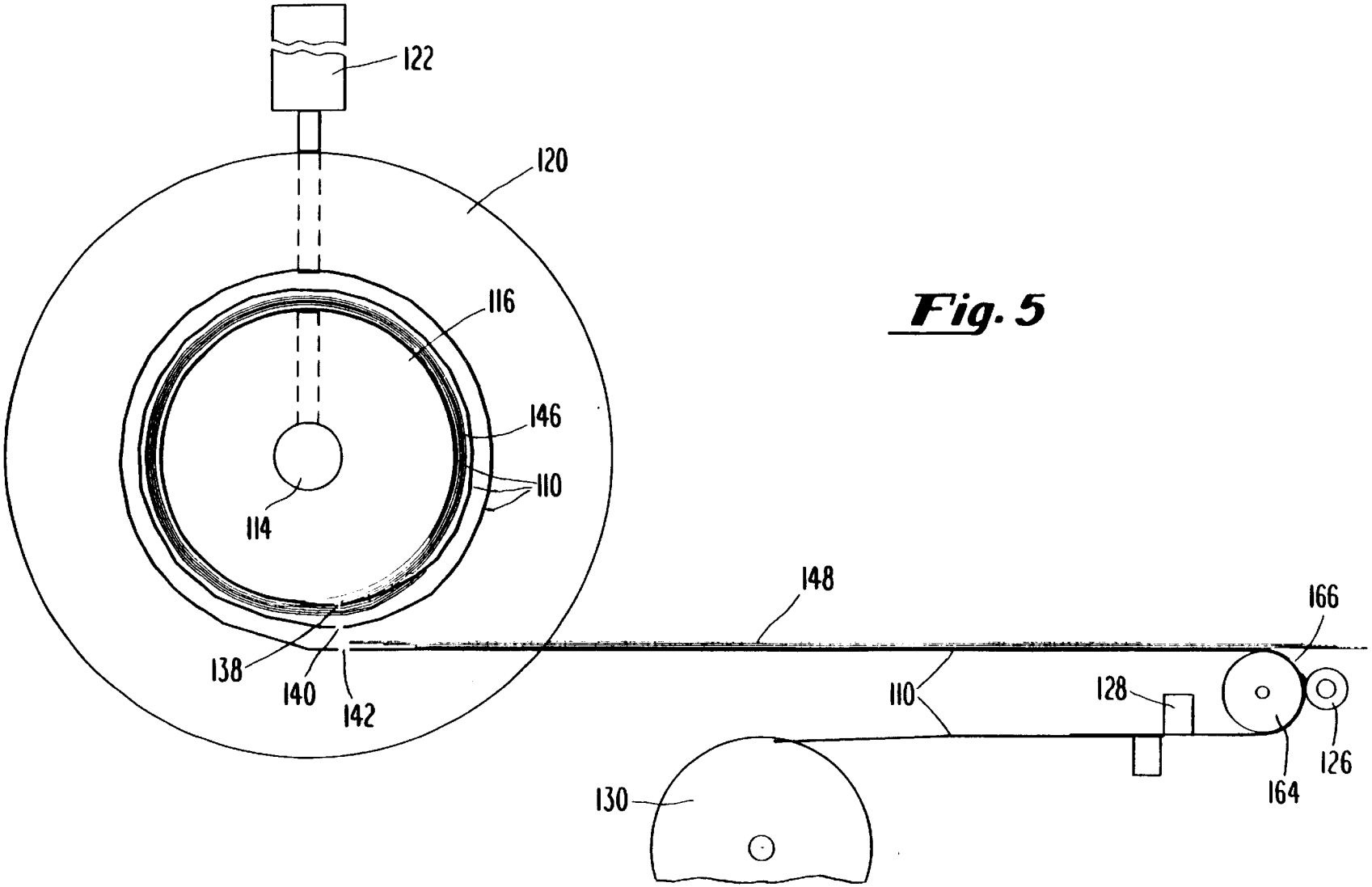
FIG. 5 is a schematic illustration of another embodiment of the inventive system for wrapping a core form with a weakened ribbon where the ribbon is used to transport fully parted amorphous strips to a mandrel.

FIG. 5 illustrates another embodiment of the present invention wherein amorphous ribbon 110, in addition to being used to secure strips 100 to mandrel 116, transports parted strips 100 to mandrel 116. Ribbon 110 is supplied from payoff 130 and passes through weakening means 128, around roller 164, and onto winding mandrel 116 where ribbon 110 is attached by temporary means. Parted strips 100 are provided using parting and grouping devices not illustrated. Parted strips 100 are inserted onto ribbon 110 in locations such that the joint regions coincide with weakened areas of ribbon 110.

Operation of this second embodiment of the present inventive system is similar to the previously described embodiment with the exception that ribbon 110 acts as the transport means. The clockwise rotation of shaft 114 and mandrel 116 pulls weakened ribbon 110 onto mandrel 116. As ribbon 110 moves, it carries cut strips 100. As in the previous embodiment, more than one weakened ribbon 110 can be wound at a time, and more than one wrap of ribbon 110 can be made between insertion of cut strips 100. As shown, first packet 146 has been wound onto mandrel 116 with an extra wrap of ribbon 110 around first packet 146. It should be noted, that although a second wrap of ribbon 110 has been made between insertion of packets 146 and 148, a weakened area 140 was inserted between weakened areas 138 and 142.

As shown, second packet 148 is ready to be wound onto mandrel 116 after having been transported to the insertion point by ribbon 110. Weakened area 166 is shown located around roller 164, after having been weakened by weakening means 128. In this embodiment shaft positioning device 122 raises mandrel 116 to maintain a constant insertion height for ribbon 110 being wrapped. Encoder 12 6 measures the length of ribbon 110 as it passes around roller 164. These measurements are used to determine lengths between weakening locations so as to maintain desired join is overlap and to adjust joint position.

Alternatively, this invention could be employed so that the mandrel does not rotate but rather the strips and ribbon are rotated around the mandrel. In such a system, a payoff spool and weakening means may be rotated around the periphery of the mandrel. Cut strips are fed at a fixed location while weakened ribbon is rotated around the mandrel to fasten the cut strips to the mandrel.

It will be appreciated by those skilled in the art that the foregoing has set forth the presently preferred embodiment of the invention and an illustrative embodiment of the invention but that numerous alternative embodiments are possible without departing from the novel teachings of the invention. For example, those skilled in the art will appreciate that mandrel 116 could have many different shapes. Further, the means for feeding strips 100 onto the mandrel could likewise take many different forms including a moveable belt or rollers. Accordingly, all such modifications are intended to be included within the scope of the appended claims.

I claim:

1. A system for wrapping transformer cores, comprising: cut strips of amorphous metal;

a ribbon spool having a supply of amorphous metal ribbon;

a wrapping mandrel situated relative to said cut strips and said ribbon spool so that as said wrapping mandrel rotates, a first plurality of said cut strips are applied to said wrapping mandrel, a first length of said amorphous metal ribbon from said ribbon spool is applied over said first plurality of said cut strips, a second plurality of said cut strips is applied over said first length of said amorphous metal ribbon, and a second length of said amorphous metal ribbon from said ribbon spool is applied over said second plurality of said cut strips.

2. The system of claim 1 wherein said ribbon spool comprises one or more amorphous metal ribbons having weakened areas at predetermined locations.

3. The system of claim 1, further comprising a moveable belt and clamp, wherein said clamp secures said first plurality and said second plurality of strip to said moveable belt while the strip is transported to said wrapping mandrel and said clamp releases the strip when the strip is wound onto said wrapping mandrel.

4. The system of claim 1 wherein said ribbon spool comprises:

a ribbon payoff from which ribbon is unspooled;

an encoder for tracking a length of ribbon and determining an appropriate location to weaken the ribbon; and a weakening device for weakening ribbon in the appropriate locations as determined by said encoder.

5. The system of claim 1 further comprising a positioning device operably connected to said mandrel for adjusting the location of said mandrel as the strip and ribbon are wound onto the mandrel so as to compensate for the increased build of the wound strip and ribbon.

6. The system of claim 1, further comprising a movable pressure plate, said pressure plate operable to come in contact with the ribbon being wound onto the mandrel so as to add tension to the ribbon.

7. The system of claim 1, wherein said first length of amorphous metal ribbon has at least one weakened area and said second length of amorphous metal ribbon has at least one weakened area.

8. The system of claim 1, wherein said cut strips of amorphous metal are wrapped with additional lengths of said amorphous metal until a predetermined size of transformer core is reached.

9. A machine for wrapping a transformer core having a joint region, comprising:

means for providing amorphous metal fully cut strips;

means for providing an amorphous metal ribbon;

means for weakening said amorphous metal ribbon at appropriate locations; and means for wrapping a first plurality of said amorphous metal fully cut strips around a mandrel, wrapping said amorphous metal ribbon over said first plurality of said amorphous metal fully cut strips, wrapping a second plurality of amorphous metal fully cut strips over said amorphous metal ribbon, and wrapping said amorphous metal ribbon over said second plurality of said amorphous metal fully cut strips.

10. The machine of claim 9, wherein said means for providing said plurality of amorphous metal fully cut strips comprises a transport means for moving said plurality of amorphous metal fully cut strips to said mandrel.

11. The machine of claim 10, wherein said transport means comprises one or more amorphous metal ribbons having weakened areas at appropriate locations.

12. The machine of claim 10, wherein said transport means comprises a moveable belt and a clamp, wherein said clamp secures the strip to said moveable belt while the strip is transported to said means for wrapping and said clamp releases the strip when the strip is wound onto said means for wrapping.

13. The system of claim 12 wherein said supply of amorphous metal ribbon comprises weakened areas at appropriate locations.

14. The system of claim 12, further comprising a moveable belt and clamp, wherein said clamp secures said first plurality of said cut strips to said moveable belt while said first plurality of said cut strip is transported to said wrapping mandrel and said clamp releases said first plurality of said strips when said first plurality of said cut strips is wound onto said wrapping mandrel, and wherein said clamp secures said second plurality of said cut strips to said moveable belt while said second plurality of said cut strips is transported to said wrapping mandrel and said clamp release said second plurality of said cut strips when said first plurality of cut strips is wound onto said wrapping mandrel.

15. The system of claim 12 wherein said ribbon spool comprises:

a ribbon payoff from which said amorphous metal the ribbon is unspooled;

an encoder for tracking the length said amorphous metal ribbon and determining an appropriate location to weaken said amorphous metal ribbon; and a weakening device for weakening said amorphous metal ribbon at locations as determined by said encoder.

16. The system of claim 12 further comprising a positioning device operably connected to said wrapping mandrel for moving said wrapping mandrel so that said wrapping mandrel is maintained in a substantially constant position relative to said cut strips as said cut strip and said amorphous metal ribbon wrap onto said wrapping mandrel.

17. The system of claim 12, further comprises a movable pressure plate, said pressure plate operable to come in contact with said amorphous metal ribbon being wrapped onto said wrapping mandrel so as to add tension to said amorphous metal ribbon.

* * * * *

UNITED STATES PATENT AND TRADEMARK OFFICE

CERTIFICATE OF CORRECTION

PATENT NO. : 6,615,482 B2
DATED : September 9, 2003
INVENTOR(S) : Mark E. Rand

It is certified that error appears in the above-identified patent and that said Letters Patent is hereby corrected as shown below:

Column 9,
Replace claims 1, 4 and 6, with the following:

1. A system for wrapping transformer cores, comprising:

cut strips of amorphous metal;

a ribbon spool having a supply of amorphous metal ribbon;

a wrapping mandrel situated relative to said cut strips and said ribbon spool so that as said wrapping mandrel rotates, a first plurality of said cut strips are applied to said wrapping mandrel, a first length of said amorphous metal ribbon from said ribbon spool is applied over said first plurality of said cut strips, a second plurality of said cut strips is applied over said first length of said amorphous metal ribbon, and a second length of said amorphous metal ribbon from said ribbon spool is applied over said second plurality of said cut strips.

4. The system of claim 1 wherein said ribbon spool comprises:

a ribbon payoff from which said amorphous metal ribbon is unspooled;

an encoder for tracking a length of said amorphous metal ribbon and determining an appropriate location to weaken said amorphous metal ribbon; and a weakening device for weakening said amorphous metal ribbon at locations as determined by said encoder.

6. The system of claim 1, further comprising a movable pressure plate, said pressure plate operable to come in contact with said amorphous metal ribbon being wrapped onto said wrapping mandrel so as to add tension to said amorphous metal ribbon.

Signed and Sealed this

Sixth Day of July, 2004

JON W. DUDAS
*Acting Director of the United States Patent and Trademark Office*